US007467958B2

(12) United States Patent
Patterson et al.

(10) Patent No.: US 7,467,958 B2
(45) Date of Patent: Dec. 23, 2008

(54) ELECTRICAL CONNECTOR HAVING LEVER WITH PROTECTIVE SHROUD

(75) Inventors: Jeremy Christin Patterson, Greensboro, NC (US); Randy Gray Simmons, Winston-Salem, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/810,373

(22) Filed: Jun. 5, 2007

(65) Prior Publication Data

US 2008/0233790 A1 Sep. 25, 2008

Related U.S. Application Data

(60) Provisional application No. 60/919,437, filed on Mar. 22, 2007.

(51) Int. Cl.
*H01R 13/62* (2006.01)

(52) U.S. Cl. ..... 439/157

(58) Field of Classification Search ..... 439/157, 439/372, 159, 160

See application file for complete search history.

(56) References Cited

U.S. PATENT DOCUMENTS

| | | | | |
|---|---|---|---|---|
| 7,052,293 | B2 * | 5/2006 | Koshy et al. | 439/157 |
| 7,267,564 | B2 * | 9/2007 | Bauman et al. | 439/157 |
| 2002/0025704 | A1 * | 2/2002 | Takata | 439/157 |
| 2004/0192090 | A1 * | 9/2004 | Flowers et al. | 439/157 |
| 2007/0207648 | A1 * | 9/2007 | Fukatsu et al. | 439/157 |

* cited by examiner

*Primary Examiner*—Gary F. Paumen

(57) ABSTRACT

An electrical connector assembly is shown having a housing member with a lever assist which rotatably draws complimentary connectors together. The lever assist is attached by way of mounting studs to a shroud on each side of the sidewall of the connector housing where the lever arms are positioned within the shroud to protect the lever arms and the gear teeth on the free ends of the lever arms.

19 Claims, 4 Drawing Sheets

*Figure 1*
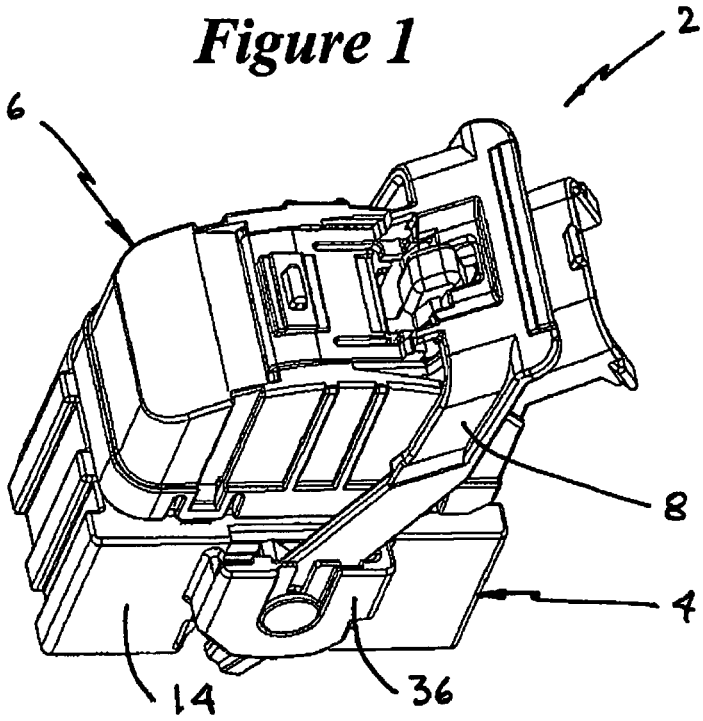
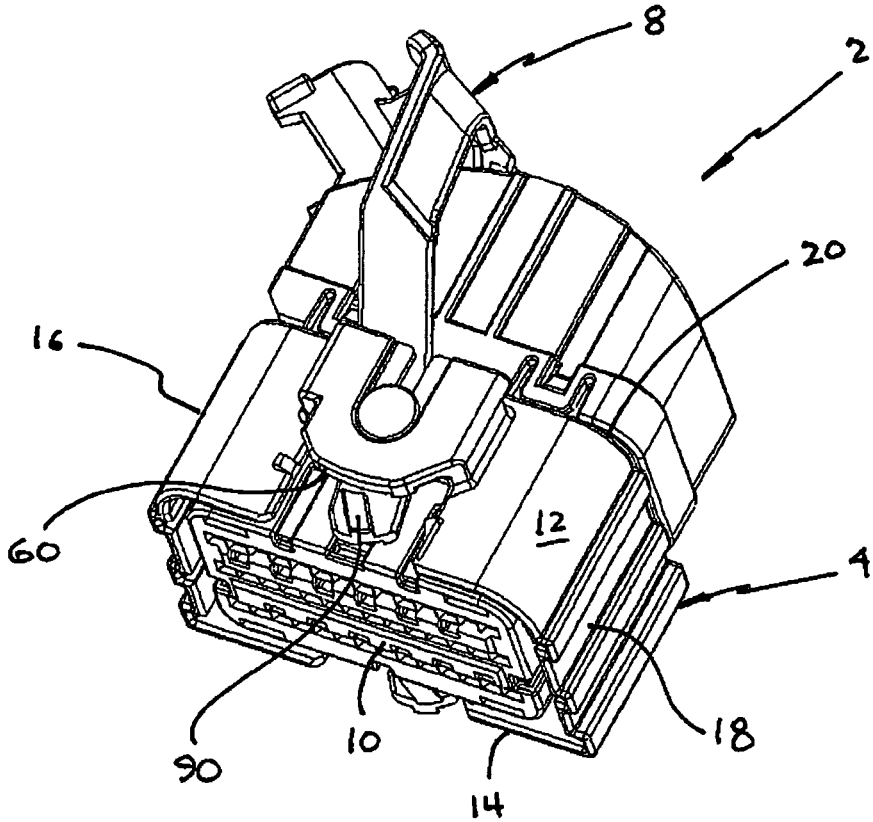
*Figure 2*

ELECTRICAL CONNECTOR HAVING LEVER WITH PROTECTIVE SHROUD

This application claims priority from Provisional Patent Application Ser. No. 60/919,437, the entirety of which is incorporated herein by reference.

The subject application related to electrical connectors and more importantly to electrical connectors having a mating assist feature such as a lever, to draw complementary connectors together.

In certain applications, electrical connectors must be securely mated to one another to prevent disconnection of the electrical signals routed through the connector conductors. In those same applications, it is desirable that the connectors be fully mated.

For example, in automotive applications wherein electrical signals are routed to safety equipment such as air bag deployment systems or other systems relating to the operational or safety features of the vehicle, disconnection of the electrical signals as a result of accident, negligence, or operating conditions such as vibration, etc. may result in undesirable consequences. These connectors systems further require assistance in mating, as multiple pairs of contacts are being connected. Thus, the mating force can be too high for the operator, or mechanic in the case of automotive applications, to accomplish by hand.

Also one of the many requirements in connector applications, particularly in automotive applications, is to rigidify all of the latching and/or mating features of the complementary pair of connectors, such that the connectors may withstand certain forces and not be broken or the electrical connection degraded. Many automotive standards have force test requirements whereby forces are exerted on various components of an electrical connector assembly and the connectors must withstand the forces applied.

SUMMARY OF THE INVENTION

In a first embodiment, an electrical connector assembly comprises a housing having a front mating face and side walls, the housing having a plurality of terminal receiving cavities extending therethrough, the housing having a shroud positioned on each sidewall comprising a wall spaced from the sidewall forming an opening. A lever is rotatably connected to the housing, the lever comprising individual arms which reside adjacent to the sidewalls and are received in and through the opening, the levers having a mating assist portion adjacent to free ends of the lever arms being protected by the shrouds.

In another embodiment, an electrical connector assembly comprises a housing having a front mating face and side walls, the housing having a plurality of terminal receiving cavities extending therethrough. The housing has a shroud positioned on each sidewall comprising a wall spaced from the sidewall forming an opening. A lever is rotatably connected to the housing, the lever comprising individual lever arms which reside adjacent to the sidewalls and are received in and through the openings, the levers having a protrusion upstanding from the lever arm, which extends beyond a lower edge of the shroud wall.

BRIEF DESCRIPTION OF THE DRAWINGS

FIG. 1 is a top perspective view of the electrical connector assembly of the present invention;

FIG. 2 is a lower perspective view of the connector assembly of FIG. 1;

DETAILED DESCRIPTION OF THE PREFERRED EMBODIMENT

Figure 3:
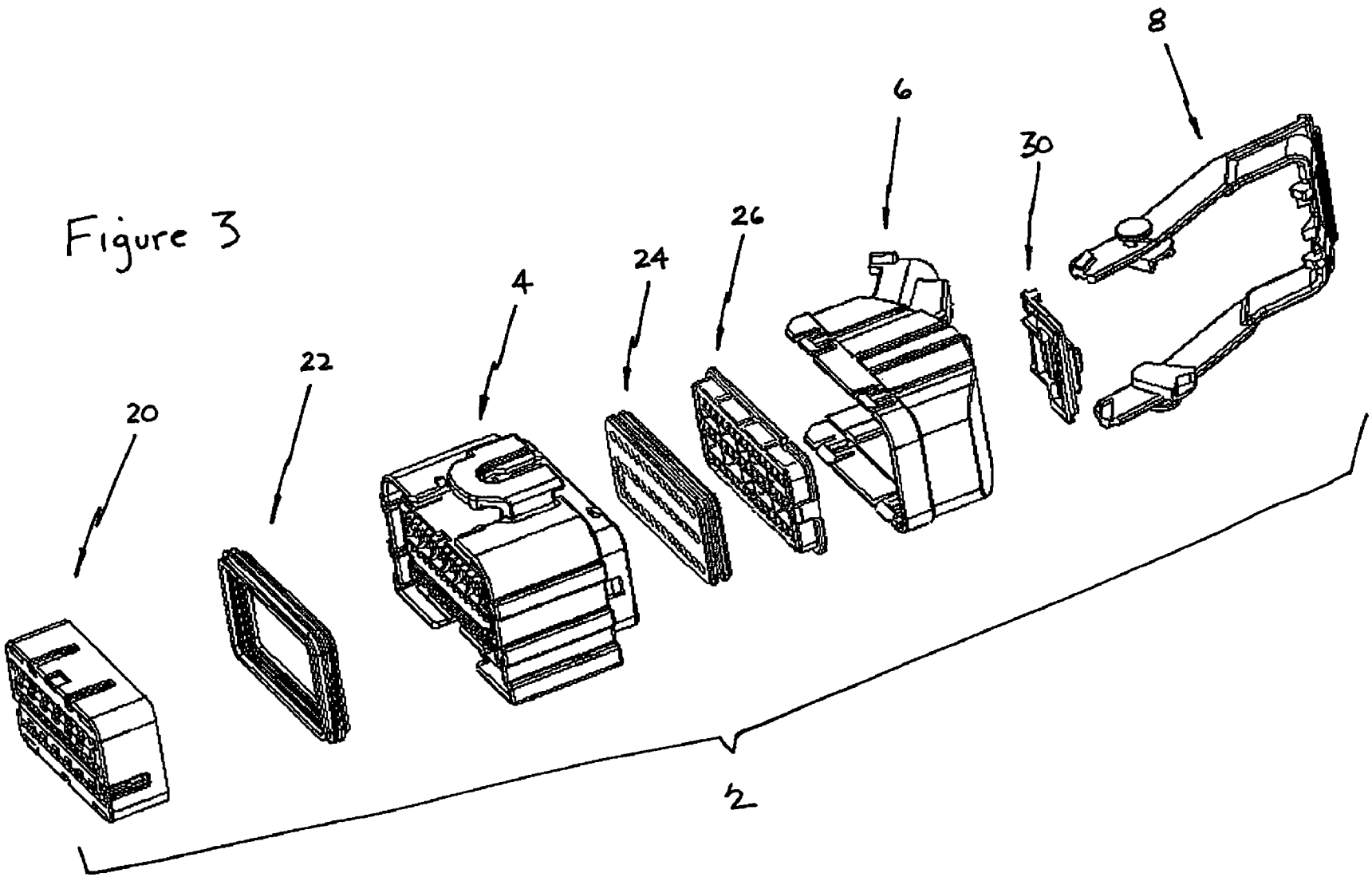
FIG. 3 is an exploded view of the assembly of either FIG. 1 or 2.

With reference first to FIG. 1, an electrical connector assembly is shown at 2 which generally comprises a housing member 4, a wire dress cover 6 and a mating assist member 8 in the form of a lever. As shown in FIG. 2, the housing member 4 is generally comprised of a front mating face 10, sidewalls 12 and 14, end walls 16 and 18 and a top wall at 20.

With reference now to FIG. 3, the connector assembly 2 will be described in greater detail. As shown in FIG. 3, housing member 4, wire dress cover 6 and mating assist member 8 are shown exploded away from each other but poised for connection thereto. The assembly 2 further comprises a terminal position assurance member (TPA) 20, a peripheral seal 22, a mat (or interfacial) seal 24, a mat seal cover 26 and a connector position assurance member 30. All of these items will not be described in detail in this application, but are further described in simultaneously filed patent applications, Ser. Nos. 11/810,288 and 11/810,232, the entirety of which is incorporated herein by reference.

Figure 4:
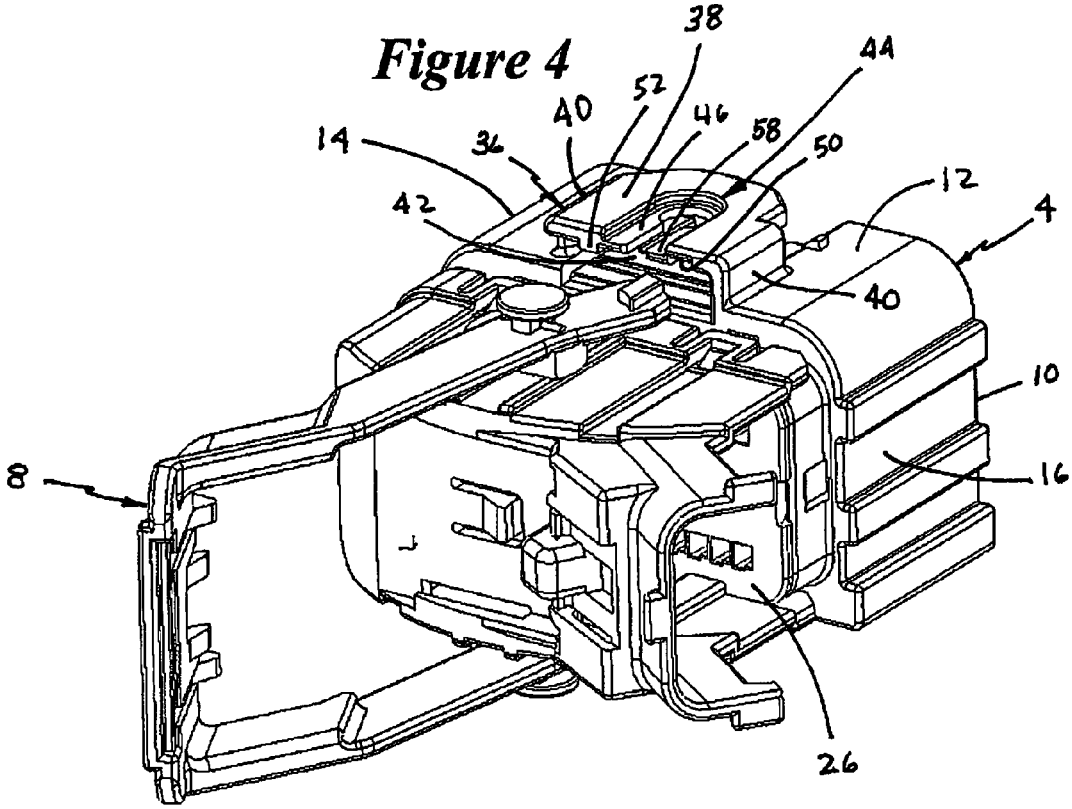
FIG. 4 is a perspective view similar to that of FIG. 1 showing the lever in position to be received in the connector housing of the embodiment of FIG. 1 or 2.
Figure 6:
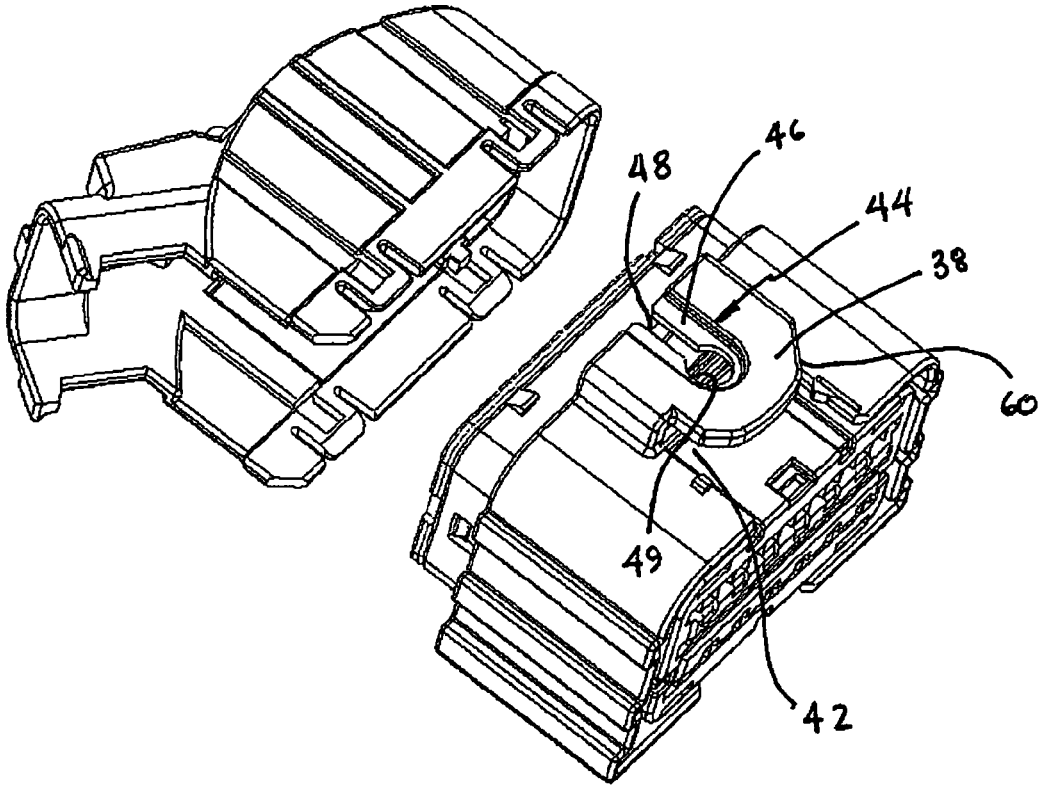
FIG. 6 is a figure showing the wire dress cover exploded from a connector housing.

With reference now to FIGS. 1, 4 and 6, housing 4 generally includes a shroud 36 formed on each sidewall 12 and 14, where shroud 36 includes a shroud wall 38 (FIG. 4) spaced apart from sidewalls 12 and 14 by way of walls 40. Shroud wall 38 is spaced apart from sidewalls 12 and 14 to form an opening 42 for receipt of the mating assist member 8 as described herein. An outer surface of shroud wall 38 includes a receiving area generally shown as 44 which includes a U-shaped recess 46 having an elongate slot 48 extending along the length of the U-shaped recess, which opens into an enlarged opening 49. An inside surface of the shroud wall 38 includes a channel 50 and a stubbing surface 52, for the proper receipt of the mating assist member 8 as described herein. The sidewalls 12 and 14 include a bearing bar 58 in alignment with the elongate slot 48 as described herein. A lower edge 60 of shroud wall 38 is shown generally as including an arcuate shape.

Figure 5:
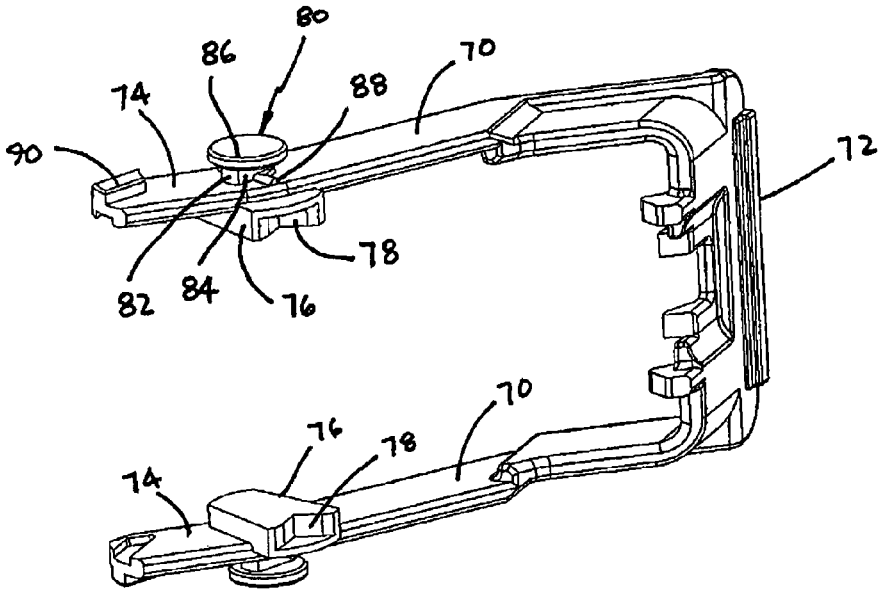
FIG. 5 is a perspective view of the lever shown in FIG. 4.

With reference now to FIG. 5, mating assist member 8 generally includes individual lever arms 70 with a connecting member 72 forming a lever handle where each of the lever arms 70 includes a free end at 74. The individual lever arms 70 include mating assist portions 76 located on the inside surface of the lever arms, and which are preferably in the form of gear teeth such as 78 to drivingly engage complementary gears on a complementary header connector (not shown) to draw the two connectors into mating engagement. Mounting studs 80 are positioned on the opposite sides of the mating assist members 76, and are receivable in U-shaped recesses 46 as described herein. The mounting studs 80 include shank portions 82 having flattened sidewall portions 84 with an enlarged stud 86 positioned above shank portion 82. A projection 88 is positioned on an outside surface of the lever arm adjacent to the shank portion 84. Finally a lever protrusion 90 is positioned outwardly of the mounting studs 80, towards the free end.

With reference again to FIG. 4, mating assist member 8 is shown poised for receipt within the housing. When installing mating assist member 8 within shroud 36, protrusions 90 are positioned within channel 50 which orients the mating assist member 8 in the proper direction relative to housing 4. Stubbing surface 52 prevents incorrect assembly of the mating assist member 8, if it were attempted to install the mating assist member 8 backwards. After installation of the mating connector, movement of the mating assist member 8 towards end wall 16 of housing 4 positions flattened sidewall portions 84 of shank portion 82 within slot 48 (FIG. 6) of the receiving areas 46.

When the shank portion 82 reaches the enlarged opening 49, lever protrusions 90 will snap past the edge 60 of shroud 36 and be trapped thereby as shown for example in FIG. 2. Thus, the projections 90 are positioned beyond arcuate surfaces 60 and retain the mating assist member 8 within shroud 36, during the pivotal movement of mating assist member 8. Also in this position, shank portion 82 is received within the circular opening 49 allowing the lever to be moved clockwise and counterclockwise but yet be trapped in place by lever protrusions 90 on each side thereof. The mating assist member 8 may be removed by depressing the projections 90, to allow the lever arms 70 to be withdrawn from the receiving areas 44. Also when in this position, the inside surface of lever arms 70 are positioned adjacent to bearing bars 58 (FIG. 4) and together with projections 88 which are interference fit against an inside surface of wall 38, take up any clearance, so that there is no rattling between the lever arms 70 and the housing 4.

As the lever assist member 8, and the mating assist portions 76 are positioned inside the shroud 36, these members are protected thereby from forces acting upon them.

What is claimed is:

1. An electrical connector assembly, comprising:

a housing having a front mating face and side walls, the housing having a plurality of terminal receiving cavities extending therethrough, the housing having a shroud positioned on each sidewall comprising a wall spaced from said sidewall forming a receiving area, opening away from the front mating face;

a lever rotatably connected to the housing, the lever comprising individual lever arms which reside adjacent to the sidewalls and are received in and through the receiving area, the levers having mating assist portions adjacent to free ends of the lever arms being protected by the shrouds, and the lever arms include mounting studs which are received in the receiving areas in the shrouds.

2. The electrical connector assembly of claim 1, wherein the lever arm includes a protrusion upstanding from the lever arm, which extends beyond a lower edge of the shroud wall.

3. The electrical connector assembly of claim 2, wherein the lower edge of the shroud is arcuate in shape, and the protrusion extends beyond the shroud lower edge and retains the lever within the shroud.

4. The electrical connector of claim 2, wherein an inner surface of the shroud includes a channel which receives the protrusion therethrough when the lever is properly oriented.

5. The electrical connector of claim 4, wherein an inner surface of the shroud includes a stubbing surface which abuts the protrusion and prevents the lever from entry into the opening when the lever is improperly oriented.

6. The electrical connector of claim 1, wherein the receiving areas comprise U-shaped recesses recessed within an outer surface of the shroud walls, with an elongate slot within the recess.

7. The electrical connector of claim 6, wherein the mounting studs comprises a shank portion receivable within the elongate slots and an enlarged stud received in the U-shaped recesses.

8. The electrical connector of claim 6, wherein the housing sidewalls include a bearing bar positioned in alignment with the elongate slots, which allow sliding engagement with the lever arms.

9. The electrical connector of claim 7, wherein the lever arms comprise a projection adjacent to the mounting studs and are profiled for interference fit against an inner surface of the shroud, and take up the clearance between the shroud and mounting stud.

10. An electrical connector assembly, comprising:

a housing having a front mating face and side walls, the housing having a plurality of terminal receiving cavities extending therethrough, the housing having a shroud positioned on each sidewall comprising a wall spaced from said sidewall forming an opening;

a lever rotatably connected to the housing, the lever comprising individual lever arms which reside adjacent to the sidewalls and are received in and through the openings, the levers having a protrusion upstanding from the lever arm, which extends beyond a lower edge of the shroud wall.

11. The electrical connector assembly of claim 10, wherein the levers have a mating assist portion adjacent to free ends of the lever arms being protected by the shrouds.

12. The electrical connector assembly of claim 10, wherein the lever arms include mounting studs which are received in receiving areas in the shrouds.

13. The electrical connector assembly of claim 10, wherein the lower edge of the shroud is arcuate in shape, and the lever protrusion extends beyond the shroud lower edge and retains the lever within the shroud.

14. The electrical connector of claim 13, wherein an inner surface of the shroud includes a channel which receives the lever protrusion therethrough when the lever is properly oriented.

15. The electrical connector of claim 14, wherein an inner surface of the shroud includes a stubbing surface which abuts the lever protrusion and prevents the lever from entry into the opening when the lever is improperly oriented.

16. The electrical connector of claim 12, wherein the receiving areas comprise U-shaped recesses recessed within an outer surface of the shroud walls, with an elongate slot within the recess.

17. The electrical connector of claim 16, wherein the mounting studs comprises a shank portion receivable within the elongate slots and an enlarged stud received in the U-shaped recesses.

18. The electrical connector of claim 17, lever arms comprise a projection adjacent to the mounting studs and are profiled for interference fit against an inner surface of the shroud, and take up the clearance between the shroud and mounting stud.

19. The electrical connector of claim 16, wherein the housing sidewalls include a bearing bar positioned in alignment with the elongate slots, which allow sliding engagement with the lever arms.

* * * * *